United States Patent [19]

Jennings et al.

[11] Patent Number: 4,513,586

[45] Date of Patent: Apr. 30, 1985

[54] COMBINATION COMPRESSOR SUPPORT AND DRAIN PAN

[75] Inventors: William B. Jennings, Collierville, Tenn.; Edward B. Shelton, Liverpool; Richmond S. Hayes, Jr., Fayetteville, both of N.Y.

[73] Assignee: Carrier Corporation, Syracuse, N.Y.

[21] Appl. No.: 450,392

[22] Filed: Dec. 16, 1982

[51] Int. Cl.[3] ..... F25D 23/12

[52] U.S. Cl. ..... 62/263; 62/285; 62/291; 62/297; 248/678

[58] Field of Search ..... 62/285, 288, 291, 262, 62/263, 297; 248/637, 678

[56] References Cited

U.S. PATENT DOCUMENTS 1,975,066 9/1934 Sanderson ..... 62/93

*Primary Examiner*—Ronald C. Capossela

*Attorney, Agent, or Firm*—Robert H. Kelly

[57] ABSTRACT

A combination compressor support and drain pan for use in a heat exchange unit is disclosed. A compressor support is mounted to a vertically extending partition and spaced a selected distance from the bottom of the unit such that a compressor may be mounted thereon. A drain bracket is secured between the partition and the compressor support to provide both structural integrity for the support and to divert condensate collected by the support to a separate drain pan.

8 Claims, 3 Drawing Figures

COMBINATION COMPRESSOR SUPPORT AND DRAIN PAN

BACKGROUND OF THE INVENTION

1. Field of the Invention

The present invention relates to a combination compressor support and drain pan for use in an air conditioning unit. More specifically, the present invention relates to an air conditioning unit having a vertical partition and a peripherally encasing heat exchanger having.a central opening such that the compressor is mounted a selected distance from the bottom of the unit by a combination compressor support and condensate collection pan located within the heat exchanger central opening.

2. Prior Art

Wound fin heat exchangers are well known in the refrigeration and air conditioning fields. A wound fin heat exchanger consists of a tube having a fin material wrapped about the tube in heat exchange relation therewith to promote heat transfer between fluid flowing through the tube and a separate fluid flowing over the tube. The utilization of this type of heat exchanger has been found to be both cost effective and to provide an appropriate heat transfer surface with a minimum of tube length. A type of wound fin tubing includes slit fin tubing wherein a sheet of fin material is slit laterally and then rolled to a generally U-shaped arrangement such that the non-slit portion is wound against the tube and the slit portions extend outwardly therefrom.

To make advantageous use of wound fin heat exchangers it is necessary that the heat exchanger be configured to optimize heat transfer. Additionally, since the heat exchanger is made from several lengths of wound fin tubing, the heat exchanger is typically formed in a peripherally encasing configuration such as an annular or other configuration having an opening in the middle. As disclosed herein, the peripherally encasing heat exchanger will be generally rectangular in cross section defining an opening in the center.

When utilizing a peripherally encasing heat exchanger having a central opening in combination with a vertically mounted packaged unit, if the heat exchanger is sufficiently large to encase the entire outdoor portion of the packaged unit, then it is not possible to mount a compressor to the bottom of the unit. Hence, a combination support and drain pan for securing the compressor to the partition at some distance spaced from the bottom of the unit was developed.

Additionally, by mounting the compressor within the interior opening of the peripherally encasing heat exchanger, when the heat exchanger is serving in the appropriate mode, condensate drips therefrom onto the compressor and the support. It is desirable to funnel this condensate away from the bottom portion of the heat exchanger such that cold condensate as may collect in the heating mode of operation of a heat pump when the outdoor heat exchanger is serving as an evaporator, does not drip from one portion of the heat exchanger to another. The combination compressor support and drain pan not only serves to support the compressor but acts to divert the condensate from the upper portion of the heat exchanger and connecting tubing such that it is routed to bypass the lower portion of the heat exchanger because water could refreeze and prematurely block lower coil portions and because the presence of copper ions in the condensate could hasten corrosion of the lower coil portions. A second condensate pan is then placed below the entire heat exchanger such that the condensate diverted by the combination compressor support and drain pan is directed thereto. Additionally, by mounting the compressor within the interior opening of the heat exchanger, the wound fin tubing of the heat exchanger may serve to reduce the level of the noise emitted by the compressor. This arrangement also makes for easier serviceability.

SUMMARY OF THE INVENTION

It is an object of the present invention to provide apparatus for supporting a compressor of a heat exchange unit.

It is another object of the present invention to provide apparatus suitable for mounting on a vertical partition for securing a compressor or other component of a heat exchange unit.

It is another object of the present invention to provide a condensate collection pan to be mounted within an opening defined by a peripherally encasing heat exchanger for collecting condensate dripping from the upper portions of the heat exchanger.

It is a yet further object of the present invention to direct the collected condensate around the bottom portion of the heat exchanger to a separate drain pan.

It is a still further object of the present invention to provide a combination apparatus for serving as a compressor support, as a drain condensate pan and as condensate diversion means.

It is a further object of the present invention to provide a safe, economical, reliable and easy to install and manufacture combination compressor support and drain pan for use with a heat exchange unit.

Other objects will be apparent from the description to follow and the appended claims.

The above objects are achieved according to the preferred embodiment of the invention by the provision of a heat exchange unit including a refrigeration circuit having a compressor and an outdoor heat exchanger. The unit is divided by a vertical partition into an indoor section and an outdoor section wherein the compressor and outdoor heat exchanger are located. A horizontally extending support means secured to the partition a selected distance from the bottom of the unit includes a bottom surface for supporting a compressor and for collecting condensate. A drain bracket is secured to the partition and is positioned to buttress the support means, said drain bracket additionally acting to divert the condensate collected by the support means.

A combination compressor support and condensate collection assembly for use in a heat exchange unit having a vertically extending partition is further disclosed. The combination includes an inclined bottom member extending from the partition and inclined upwardly therefrom, inclined wedge portions extending outwardly from the sides of the bottom member, side lip portions extending upwardly from the edge of the inclined edge portions mounted adjacent the bottom member, a front lip portion extending upwardly from the inclined bottom member at the end distant from the partition and being connected to the side lip portions. The inclined bottom member defines at least one drain opening and a drain bracket affixed to the partition end to support the bottom member and said drain bracket being adapted to receive condensate from the drain opening.

DESCRIPTION OF THE PREFERRED EMBODIMENT

The embodiment as described herein is adapted for use in a vertically mounted packaged heat pump as may be used to provide conditioned air to an apartment, condominium or similar structure. The unit is designed to be mounted having an outdoor section in communication with outdoor ambient air and an indoor section for delivering conditioned air to the enclosure.

The arrangement of a combination compressor support and drain pan as set forth herein is particularly suitable for use in a unit having a vertically extending partition and a peripherally encasing heat exchanger defining a central opening. It is apparent, however, that such a device would have like applicability in heat exchange units having heat exchangers of various configurations and not necessarily being peripherally encasing heat exchangers defining central openings. It is further to be understood that although a particular packaged type heat pump is described herein this invention would have like applicability to other air conditioning units that are neither heat pumps nor packaged units. Additionally, such units as packaged terminal air conditioning units and room air or window units might be suitable application for this apparatus.

Figure 1:
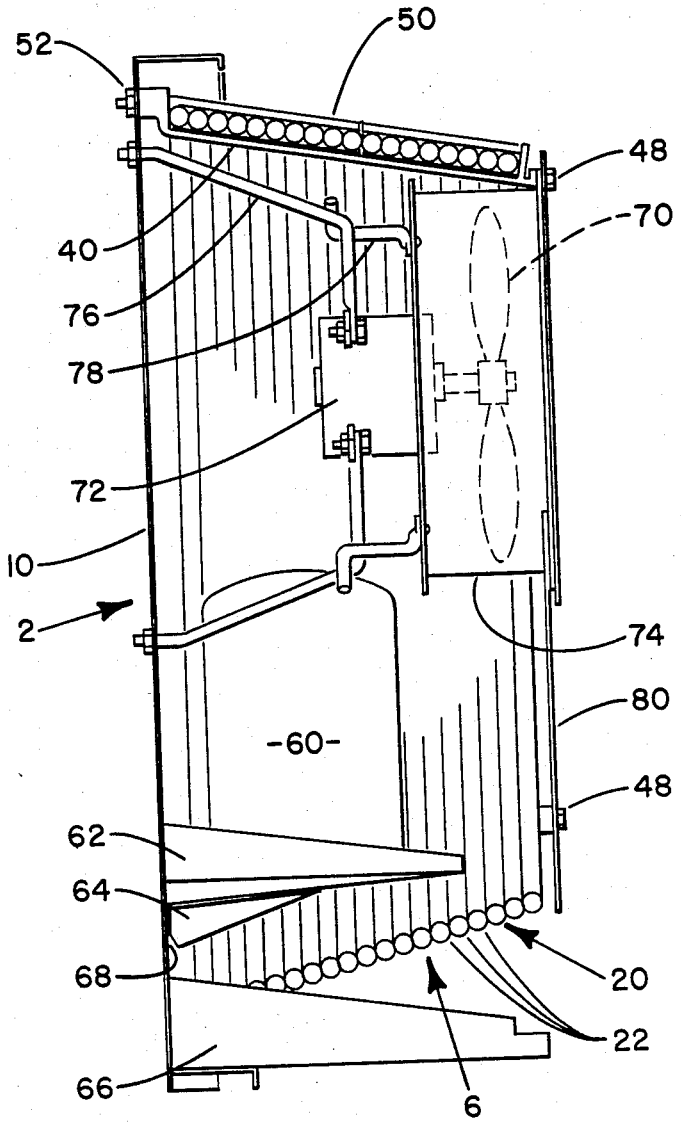
FIG. 1 is a partially cutaway side view of an outdoor section of a vertically mounted packaged air conditioning unit.

Referring to FIG. 1 there may be seen the outdoor portion of a vertically mounted packaged air conditioning unit. Partition 10 is a vertically extending support member which defines the boundary between outdoor section 6 of unit 2 and the indoor section (not shown). Heat exchanger 20 is shown mounted within the outdoor section and has compressor 60 and outdoor fan 70 mounted therewithin. Fan support legs 76 are shown secured to fan motor 72 to maintain the fan motor in position relative to partition 10. Fan orifice support 78 further connects fan orifice 74 to fan motor support legs 76 to maintain the fan orifice in position. Tube support 40 is shown at the top of the unit having loops 22 of heat exchanger 20 located between tube support 40 and rod 50. Additionally, it can be seen that nut 52 engaged to rod 50 acts to secure the tube support to the partition.

Compressor 60 of the refrigeration circuit is mounted on a compressor support 62 which additionally serves to collect condensate dripping from the upper portions of the heat exchanger. Drain bracket 64 serves to provide structural support to the compressor support 62 and to direct condensate collected therewithin to drain pan 66 through opening 68. Mounted about the exterior of the outdoor section may be seen front guard 80 which prevents air flow into that portion of the central opening defined by the heat exchanger which is not encompassed by the fan orifice. It can additionally be seen that screws 48 act to secure both fan orifice 74 and front guard 80 to the appropriate tube supports.

Additionally, it may be seen in FIG. 1 that heat exchanger 20 is made from loops 22 of wound fin heat exchange tubing wrapped to define a peripherally encasing heat exchanger having a central opening. As shown in FIG. 1, this heat exchanger is generally tapered from the partition outwardly and as may be seen in FIG. 2 is generally rectangular in configuration.

Figure 2:
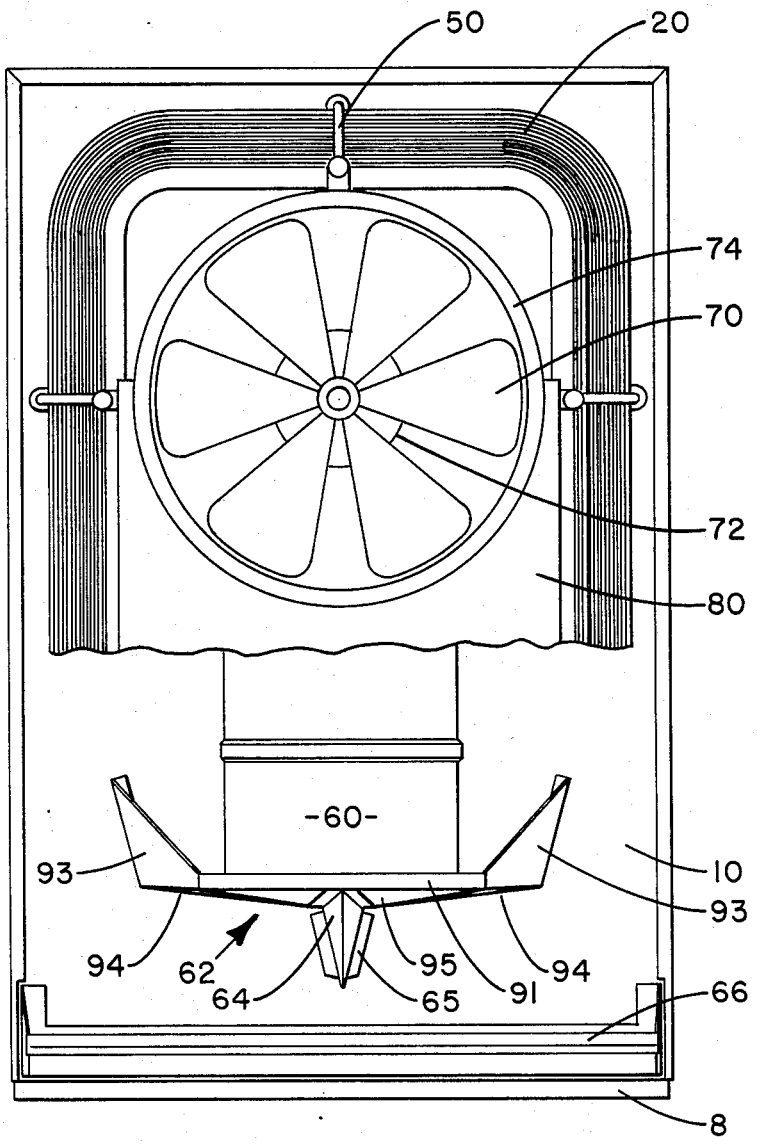
FIG. 2 is a partially cutaway end view of the same packaged unit as shown in FIG. 1.

Referring now to FIG. 2 it may be seen that compressor support 62 includes numerous segments. The compressor support includes an inclined bottom member 95, front lip 91, side lips 93 and inclined wedge portions 94. The inclined bottom surface extends from the partition and is angled upwardly and outwardly until it terminates at front lip 91. Wedge portions 94 angle outwardly and upwardly from the sides of the inclined bottom member. Side lips 93 extend upwardly from the exterior edges of the inclined wedge portions. The combination of side lips and the front lip together with the inclination of the bottom surface and wedge portions act to define a condensate collection pan. Another embodiment might eliminate the front lip and have the side lips inclined to meet the bottom member at the edge where front lip 91 was mounted.

It can additionally be seen in FIG. 2 that drain bracket 64 is formed in a V-shape and has flanges 65 for securing the drain bracket to partition 10.

In FIG. 2 it may be additionally seen that fan 70 powered by fan motor 72 is mounted within fan orifice 74 secured to tube supports including rods 50. Additionally, front guard 80 is shown partially cutaway to prevent air flow into the heat exchanger other than through the runs of tubing defining the heat exchanger. Bottom casing 8 and drain pan 66 are shown located toward the bottom of the unit. Heat exchanger 20 is shown being a peripherally encasing heat exchanger defining a center cavity wherein the compressor 60 and fan 70 are mounted.

Figure 3:
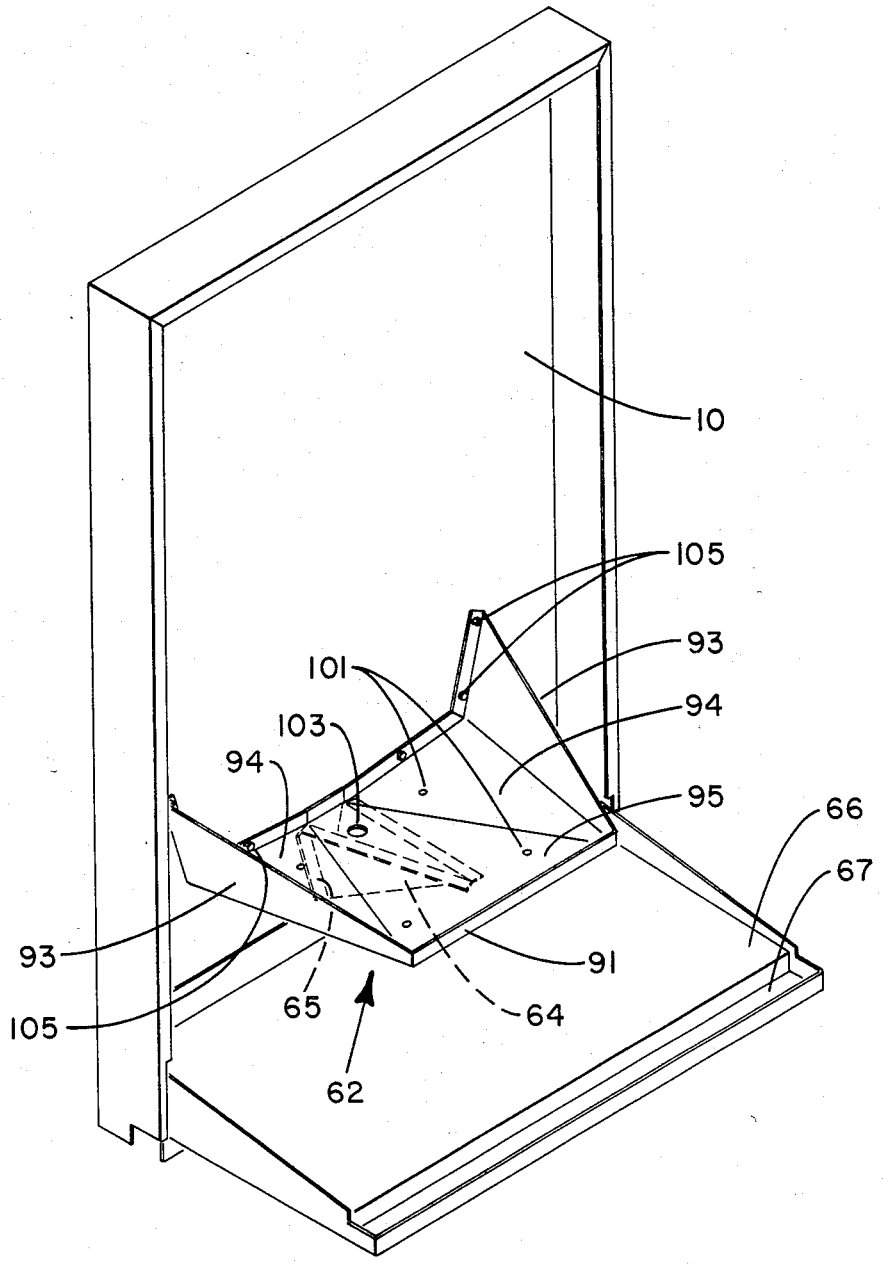
FIG. 3 is an isometric view of the compressor support drain bracket and drain pan shown mounted to the partition.

FIG. 3 is a perspective view of the partition showing just compressor bracket support 62, drain bracket 64 and drain pan 66 extending therefrom. Compressor support 62 is shown having inclined bottom 95, two wedge portions 94, side lips 93 and front lip 91 all defining a condensate collection apparatus as well as the compressor support. Mounting holes 101 are located in the bottom of the compressor support to coact with bolts extending from the compressor to secure the compressor thereto. Gromets or similar sealing devices are used such that condensate collected in the compressor support does not drip through these holes. It can be additionally seen that condensate opening 103 is provided to extend through inclined bottom 95 such that condensate collected may drip downwardly into drain bracket 64. The drain bracket then diverts the condensate backwardly such that it leaves the drain bracket at opening 68 (See FIG. 1) adjacent the partition and drops directly into drain pan 66. Screws 105 are shown for securing the compressor support to the partition.

Drain bracket 64 is shown having flanges 65 for securing the bracket to the partition. Drain bracket 64 has two angled side members as may be seen in FIG. 2 for directing the condensate to the drain pan. The drain bracket further serves to structurally support and buttress the compressor support. Drain pan 66 is shown having an inclined top surface which allows the water to drain into trough 67 from which the water is directed out of the unit through an appropriate collection means.

As described herein a combination compressor support and drain pan has been provided for mounting to a vertical member. The compressor of the refrigeration circuit is mounted to the support all within a central opening defined by a peripherally encasing heat exchanger. A drain bracket diverts the collected condensate around the bottom portion of the heat exchanger to drain pan 66.

The invention has been described with reference to a particular embodiment. It is to be understood by those skilled in the art that variations and modifications can be effected within the spirit and scope of the invention.

What is claimed is:

1. A heat exchange unit including a refrigeration circuit having a compressor and an outdoor heat exchanger, said unit being divided by a vertical partition into an indoor section and an outdoor section wherein the compressor and outdoor heat exchanger are located, which comprises:

a horizontally extending support means secured to the partition a selected distance from the bottom of the unit, said support means including a bottom surface for supporting a compressor and for collecting condensate; and a drain bracket secured to the partition and positioned to buttress the support means, said drain bracket additionally acting to divert the condensate collected by the support means.

2. The apparatus as set forth in claim 1 wherein the outdoor heat exchanger is a substantially peripherally encasing heat exchanger defining a center cavity and is mounted to the partition and wherein the support means and the drain bracket are located within the center cavity defined by the heat exchanger.

3. The apparatus as set forth in claim 2 and further comprising a drain pan located in the outdoor section below the heat exchanger, said drain pan being positioned to receive condensate directly from the heat exchanger and condensate diverted from the support means via the drain bracket.

4. The apparatus as set forth in claim 3 wherein the outdoor heat exchanger is formed from continuous sections of wound fin tubing to define a peripherally encasing structure having a center opening, said support means being located within the opening to collect condensate from those portions of the heat exchanger vertically above the condensate pan and wherein the drain pan is located exterior of said opening and below the heat exchanger.

5. The apparatus as set forth in claim 1 wherein the support means further comprises a front lip extending upwardly from the bottom surface at the end of the bottom surface distant from the partition, wedge portions extending outwardly from the sides of the bottom surface and side lips extending upwardly from the sides of the wedge portions and extending from the front lip to the partition on each side such that a container for collecting condensate is formed.

6. A combination compressor support and condensate collection assembly for use in a heat exchange unit having a vertically extending partition which comprises:

an inclined bottom member extending from the partition and inclined upwardly therefrom;

inclined wedge portions extending outwardly from the sides of the bottom member;

side lip portions extending upwardly from the edge of the inclined wedge portions not adjacent the bottom member;

a front lip portion extending upwardly from the inclined bottom member at the end distant from the partition and being connected to the side lip portions;

wherein said inclined bottom member defines at least one drain opening; and a drain bracket affixed to the partition and to the bottom member for supporting same and said drain bracket being adapted to receive condensate from the drain opening.

7. The apparatus as set forth in claim 6 and further comprising a drain pan located below the bottom member and drain bracket and wherein said drain bracket diverts condensate from the bottom member to the drain pan.

8. The apparatus as set forth in claim 7 and further comprising a heat exchanger and wherein a portion of the heat exchanger is located between the bottom member and the drain pan and wherein the drain bracket diverts condensate collected at the bottom member away from the heat exchanger as the condensate flows to the drain pan.

* * * * *